US011245185B2

(12) United States Patent
Faler et al.

(10) Patent No.: US 11,245,185 B2
(45) Date of Patent: Feb. 8, 2022

(54) PORTABLE PHASED APERTURE ARRAY ANTENNA

(71) Applicant: MILES SPACE, INC., Ft. Lauderdale, FL (US)

(72) Inventors: Wesley Faler, Dunedin, FL (US); Alex Wingeier, Palm Harbor, FL (US); Frank Fomby, Laurens, SC (US); Charles Bucher, Tampa, FL (US)

(73) Assignee: MILES SPACE, INC., Tampa, FL (US)

( * ) Notice: Subject to any disclaimer, the term of this patent is extended or adjusted under 35 U.S.C. 154(b) by 527 days.

(21) Appl. No.: 15/623,372

(22) Filed: Jun. 14, 2017

(65) Prior Publication Data

US 2018/0006373 A1 Jan. 4, 2018

Related U.S. Application Data

(60) Provisional application No. 62/350,157, filed on Jun. 14, 2016.

(51) Int. Cl.

| | |
|---|---|
| ***H01Q 3/00*** | (2006.01) |
| ***H01Q 3/34*** | (2006.01) |
| ***H01Q 1/42*** | (2006.01) |
| *H01Q 1/22* | (2006.01) |
| *H01Q 21/22* | (2006.01) |
| *H01Q 1/36* | (2006.01) |
| *H01Q 1/08* | (2006.01) |
| *H01Q 7/00* | (2006.01) |

(Continued)

(52) U.S. Cl.

CPC ..... *H01Q 3/34* (2013.01); *H01Q 1/42* (2013.01); *H01Q 1/08* (2013.01); *H01Q 1/22* (2013.01); *H01Q 1/36* (2013.01); *H01Q 1/38* (2013.01); *H01Q 7/00* (2013.01); *H01Q 21/22* (2013.01); *H01Q 21/29* (2013.01)

(58) Field of Classification Search

CPC .. H01Q 1/08; H01Q 1/22; H01Q 1/38; H01Q 1/42; H01Q 21/22; H01Q 21/29; H01Q 3/34; H01Q 7/00; H04W 16/28

USPC ..... 342/354, 368, 372

See application file for complete search history.

(56) References Cited

U.S. PATENT DOCUMENTS 3,340,531 A * 9/1967 Kefalas ..... G01S 3/42 342/353

5,905,466 A * 5/1999 Jha ..... H01Q 1/242 343/700 MS (Continued)

*Primary Examiner* — Chuong P Nguyen

(74) *Attorney, Agent, or Firm* — Peacock Law P.C.; Justin R. Muehlmeyer; Deborah A. Peacock

(57) ABSTRACT

Systems and methods can support a portable aperture array antenna system having a support structure of a substantially hemispherical geometry formed of a plurality of rigid linear elements. A membrane may be positioned upon an outer surface of the support structure. A plurality of antenna elements may be positioned coplanar to the membrane. A radio frequency transmission assembly may operate to couple output signals from the antenna elements into one or more signal-processing modules. The signal-processing modules may be configured to model the motion of two or more satellites, focus electromagnetic beams in the respective directions of the satellites, and steer the electromagnetic beams from horizon to horizon to follow the satellites simultaneously without motion of physical components.

20 Claims, 9 Drawing Sheets

(51) Int. Cl.
*H01Q 1/38* (2006.01)
*H01Q 21/29* (2006.01)

(56) References Cited

U.S. PATENT DOCUMENTS 5,995,041 A * 11/1999 Bradley ..... H04B 7/18571 342/357.75
6,111,542 A * 8/2000 Day ..... H01Q 3/04 342/359
6,124,832 A * 9/2000 Jeon ..... H01Q 1/3275 343/711
6,191,734 B1 * 2/2001 Park ..... H01Q 1/3275 342/359
6,292,134 B1 * 9/2001 Bondyopadhyay .... H01Q 3/242 342/374
6,784,838 B2 * 8/2004 Howell ..... H01Q 3/26 342/377
6,961,025 B1 * 11/2005 Chethik ..... H01Q 1/288 343/705
6,989,787 B2 * 1/2006 Park ..... H01Q 1/3275 342/359
7,248,215 B2 * 7/2007 Pleva ..... H01Q 1/3283 342/368
7,522,095 B1 * 4/2009 Wasiewicz ..... G01S 13/424 342/160
8,594,735 B2 * 11/2013 Huang ..... H01Q 21/20 455/562.1
8,779,983 B1 * 7/2014 Lam ..... H01Q 25/00 343/700 MS
9,590,722 B2 * 3/2017 Wyler ..... H04B 7/18513
10,361,773 B2 * 7/2019 Vaughan ..... B64G 1/242
10,665,940 B2 * 5/2020 Russell ..... H01Q 3/24
2009/0278744 A1 * 11/2009 Kirino ..... H01P 1/184 343/700 MS
2012/0249366 A1 * 10/2012 Pozgay ..... H04B 7/18571 342/354

* cited by examiner

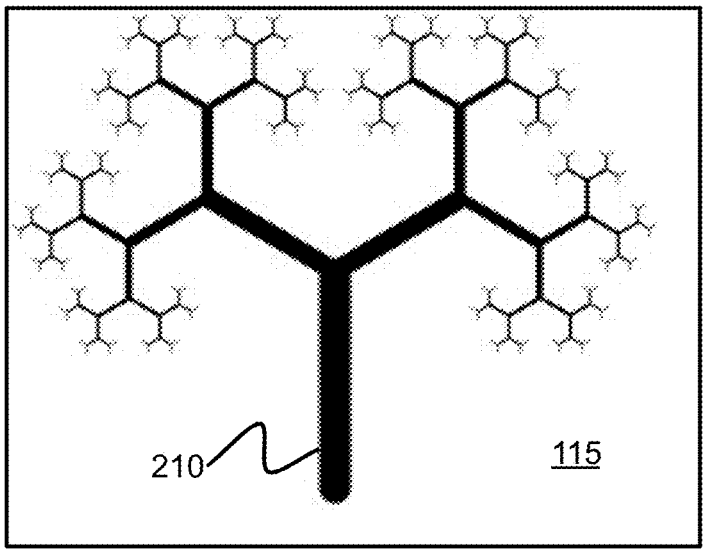
Fig. 4
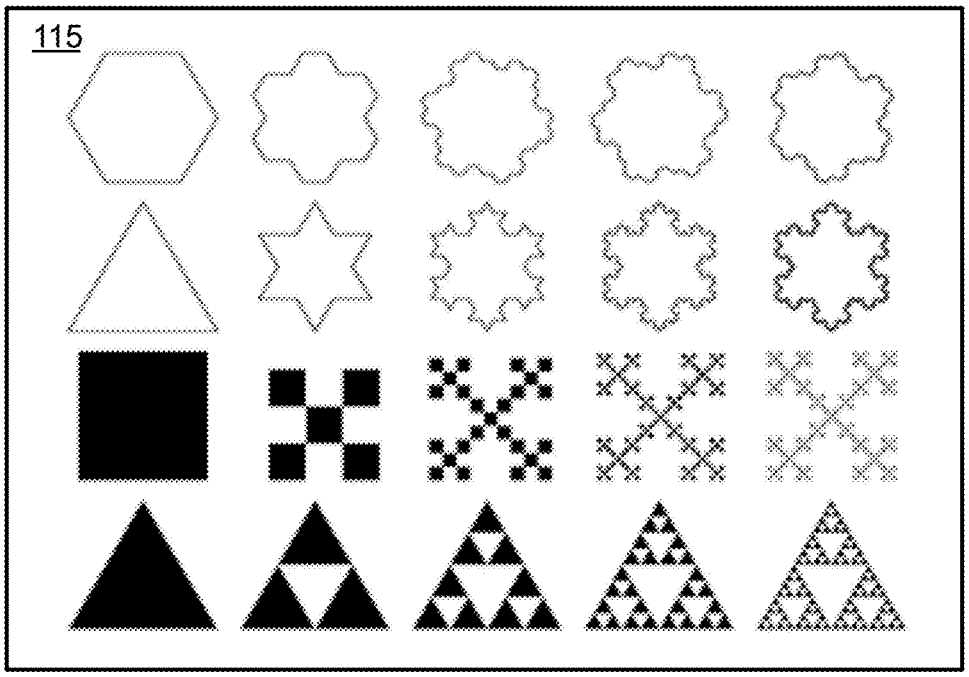

PORTABLE PHASED APERTURE ARRAY ANTENNA

RELATED APPLICATION

This application claims priority to U.S. Provisional Patent Application No. 62/350,157, filed Jun. 14, 2016 and entitled "Portable Phased Aperture Array Antenna." The complete disclosure of the above-identified priority application is hereby fully incorporated herein by reference.

BACKGROUND

Traditional satellite antennas use moving parts to track moving satellites. A moving directional antenna, typically having a dish or multi-element geometry, can only reposition to track a single satellite at once. Also, time must be allowed for the antenna to track from one satellite to another. This causes antenna downtime between satellite service windows. Furthermore, moving an antenna eventually wears out motors and mechanical assemblies. These systems thus require regular maintenance. Such service is challenging and expensive and may involve extreme locations and weather conditions to maintain a network of worldwide coverage.

Accordingly, there is a need in the art for technology providing low cost, reliable communication antenna functionality that is operable to track multiple satellites simultaneously from horizon to horizon without moving parts.

SUMMARY

In certain example embodiments described herein, methods and systems can support a portable aperture array antenna system having a support structure of a substantially hemispherical geometry formed of a plurality of rigid linear elements. A membrane may be positioned upon an outer surface of the support structure. A plurality of antenna elements may be positioned coplanar to the membrane. A radio frequency transmission assembly may operate to couple output signals from the antenna elements into one or more signal-processing modules. The signal-processing modules may be configured to model the motion of two or more satellites, focus electromagnetic beams in the respective directions of the satellites, and steer the electromagnetic beams from horizon to horizon to follow the satellites simultaneously without motion of physical components.

These and other aspects, objects, features, and advantages of the example embodiments will become apparent to those having ordinary skill in the art upon consideration of the following detailed description of illustrated example embodiments.

BRIEF DESCRIPTION OF THE DRAWINGS

FIG. 4 illustrates various fractal-inspired antenna elements within facets of an antenna system in accordance with one or more embodiments presented herein.

DETAILED DESCRIPTION OF EXAMPLE EMBODIMENTS

Overview

The methods and systems described herein enable self-contained portable aperture array antenna systems operable without moving parts. The antenna systems can utilize a horizon-to-horizon (360 degrees) view and on-board computing to mathematically track multiple moving satellites and their associated radio frequency signals.

The antenna system may comprise a three-dimensional support structure. The support structure may be "popped up" or otherwise deployed to support a whole-sky view to the multiple thin-film antennas arranged around an outer surface structure. The antenna system may comprise a plurality of membranes positioned on the outer facets of the support structure. The membranes may be substantially planar or slightly curved. The membrane may conform to the surface established by the support structure. It should be appreciated that the membranes may comprise one or more large membranes covering multiple facets or each facet may be a separate membrane mechanically coupled to the other membranes and/or to the support structure.

The membranes, or a subset thereof, may each comprise one or more thin-film antennas. The membranes, or a subset thereof, may each comprise one or more thin-film solar panels. The membranes, or a subset thereof, may each comprise one or more thin in-line batteries. The membranes, or a subset thereof, may each also comprise one or more of various radio receivers, radio frequency frontend hardware, computing hardware, or various modules implementing aperture array signal processing.

The self-contained portable aperture array antenna system can provide a horizon-to-horizon view. Even without moving parts, such an antenna system can leverage on-board computing to mathematically track multiple moving satellites simultaneously using radio frequency (RF) beam focusing also referred to as beam forming or beam steering technology. It should be appreciated that while the technology presented herein is generally discussed in the context of receiving radio signals, such technology may be used for both transmitting and receiving in full accordance with the notions of electromagnetic reciprocity.

The functionality of the various example embodiments will be explained in more detail in the following description, read in conjunction with the figures illustrating process flow. Turning now to the drawings, in which like numerals indicate like (but not necessarily identical) elements throughout the figures, example embodiments are described in detail.

Example System Architectures

Figure 1:
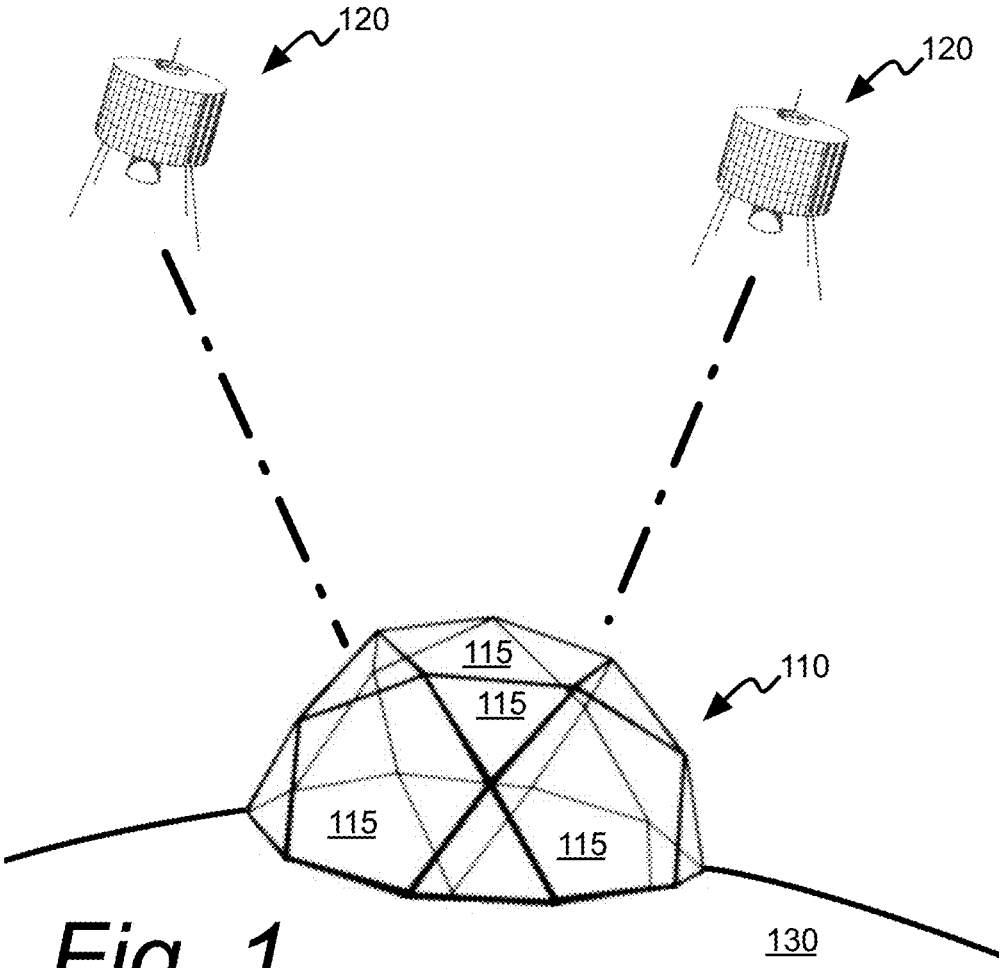
FIG. 1 is a schematic diagram illustrating a self-contained portable aperture array antenna system communicating with multiple satellites in accordance with one or more embodiments presented herein.

FIG. 1 is a schematic diagram illustrating a self-contained portable aperture array antenna system 110 communicating with multiple satellites 120 in accordance with one or more embodiments presented herein. The antenna system 110 may be located on, or near, the ground 130 and can provide a horizon-to-horizon sky view to a plurality of facets 115 making up an outer surface of the antenna system 110. The system associated with the antenna system 110 may be referred to a satellite ground system.

Such a low cost, reliable antenna system 110 can support a worldwide communication network for low-earth-orbit (LEO) satellites. A LEO satellite 120 can transit from horizon to horizon in approximately ten minutes. The antenna system 110 can comprise a three-dimensional support structure operable to be portable and deployed. For example, the structure may be "popped-up" similar to a camping tent. The support structure may comprise a substantially hemispherical geometry formed of a plurality of rigid linear elements similar.

While the three-dimensional support structure may comprise a total outside diameter of approximately one meter, it should be appreciated that the three-dimensional support structure may be variously sized as required by a particular application. The three-dimensional support structure can provide a whole-sky view to the multiple facets 115 arranged around the outer surface of the antenna system 110. The facets 115 may comprise one or more thin-film antennas.

The antenna system 110 may comprise one or more RF analog electronic modules as well as one or more digital computational electronic modules. The modules may also comprise software and algorithms. The modules may be located within the antenna system 110. For example, the modules may be position on an inside surface of one or more of the facets 115.

Figure 2:
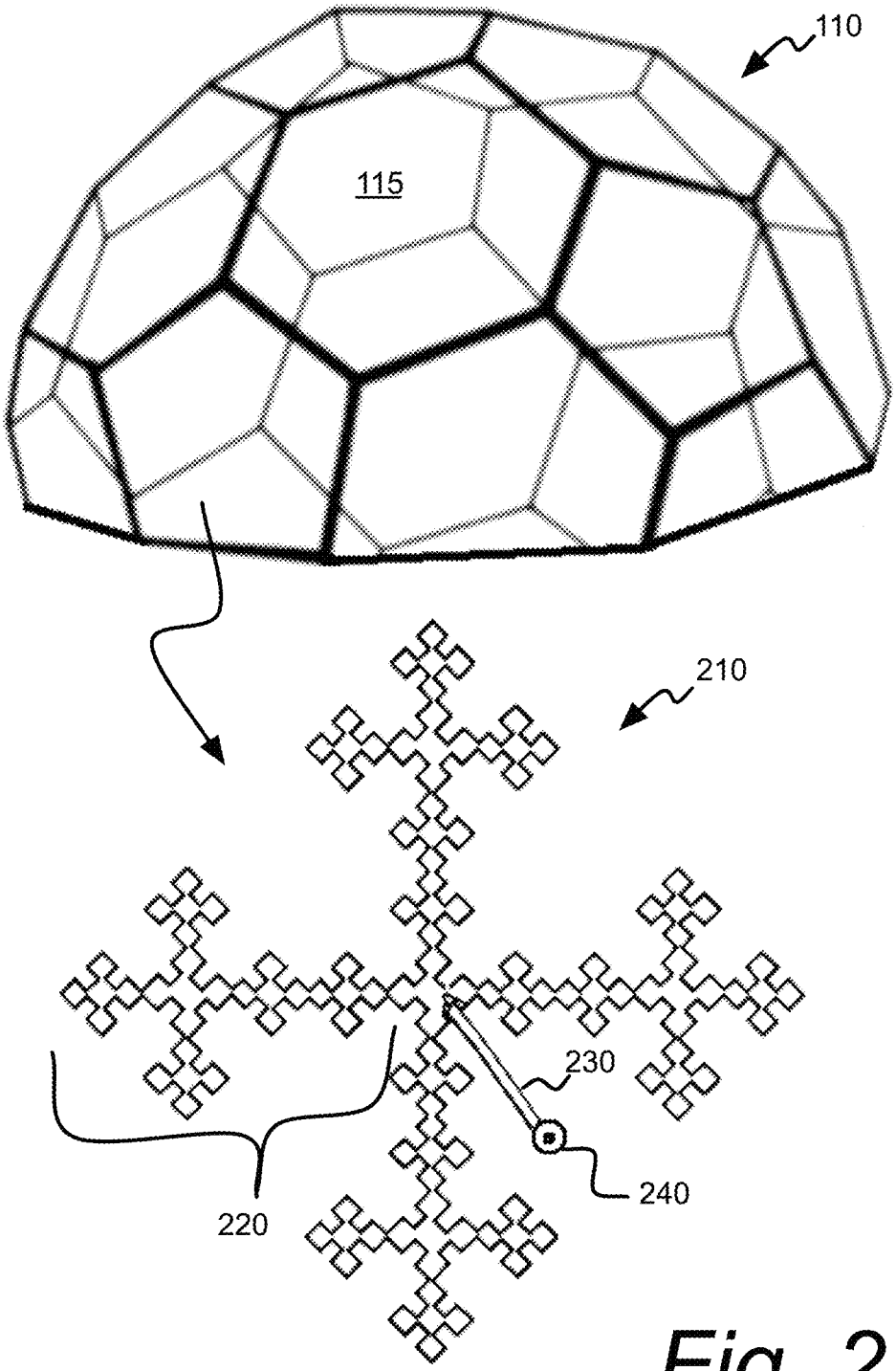
FIG. 2 is a schematic diagram depicting an antenna system featuring an array of thin-membrane antenna elements in accordance with one or more embodiments presented herein.

FIG. 2 is a schematic diagram depicting an antenna system 110 featuring an array of thin-membrane antenna elements 210 in accordance with one or more embodiments presented herein. A thin-film membrane material, such as a plastic film or woven material, may cover an outer surface of the antenna system 110. A geometry of the membrane may comprise a plurality of facets 115. Each of the facets 115, or a subset thereof, may comprise one or more thin-membrane antenna elements 210. The antenna elements 210 may comprise a conductive material, such as conductive ink, foil, or deposited metal. The antenna elements 210 may comprise a fractal-inspired geometry of two or more scaled or oriented antenna segments 220. Signals form multiple antenna segments 220 may electrically combine at a central point. The combined signals may couple to a transmission line 230. The transmission line 230 may couple to an electrical signal connector 240. The electrical signal connector 240 may be a coaxial connector (such as an SMA connector) that has been epoxied, compression coupled, soldered, or otherwise bonded onto, the membrane material and/or the transmission line 230.

The antenna elements 210 and associated communication electronics may be configured to operate from VHF or UHF frequencies up to S band or SHF frequencies. For example, the antenna system 110 may operate at frequencies from 140 MHz up to 5 GHz or significantly higher. The antenna elements 210 and/or the antenna segments 220 may comprise a physical scale on the order of one quarter of the wavelength of a radio frequency band of interest.

Figure 3:
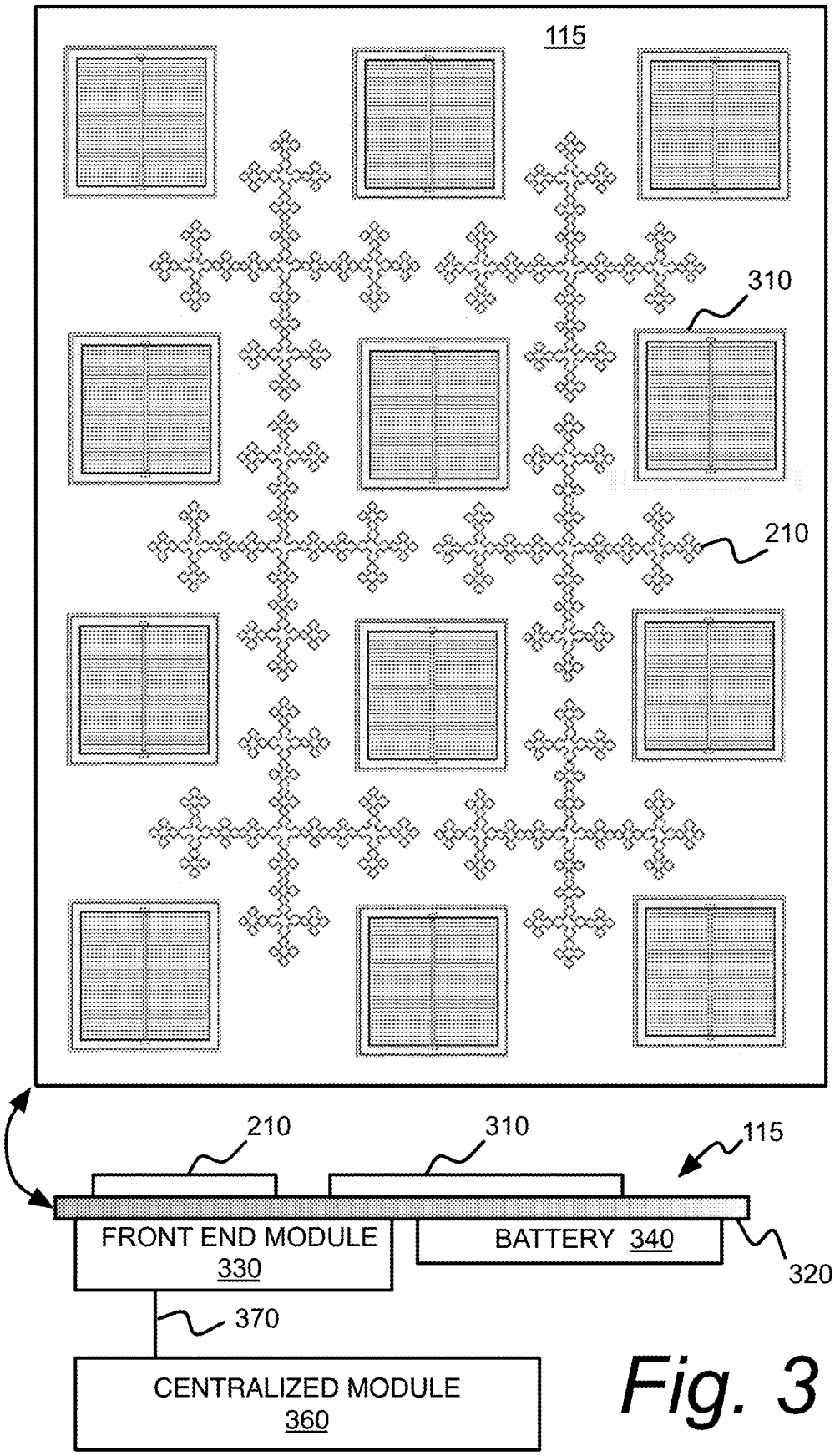
FIG. 3 is a schematic diagram depicting a facet of a self-contained portable aperture array antenna system in accordance with one or more embodiments presented herein.

FIG. 3 is a schematic diagram depicting a facet 115 of a self-contained portable aperture array antenna system 110 in accordance with one or more embodiments presented herein. The facet 115 may comprise a membrane 320 supporting an array of thin-membrane antenna elements 210 and solar cells 310. The membrane 320 can also support thin batteries 340. The thin batteries 340 may be attached to the membrane 320 or simply located within the antenna system 110 such that the membrane 320 provides protection from wind, rain, and other environmental elements.

The membrane 320 can also support processing modules such as front-end modules 330 and/or centralized modules 360. The processing modules may be attached to the membrane 320 or simply located within the antenna system 110 such that the membrane 320 provides protection from wind, rain, and other environmental threats. The processing modules, such as the front-end modules 330 and the centralized modules 360 may comprise low noise amplifiers (LNAs), low noise blocks (LNBs), radio frequency circuits, mixers, down-converters, combiners, phase shifters, switches, filters, analog to digital converters (ADCs), digital signal processors (DPSs), central processing units (CPUs), ASICs, FPGAs, mixed signal processor circuits, other hardware modules, software modules, firmware modules, and so forth.

According to certain embodiments, the thin film membrane 320 may comprise a three-film technology where the innermost layer comprises a cavity configured to support film batteries 340. The middle and outermost layer may sandwich or otherwise support antenna elements 210 and/or solar cells 310.

The volume within the antenna system 110 may comprise an approximately hemispherical geometry. Various signal processing and computing modules, such as the centralized modules 360, may be located within this inner volume. The front-end modules 330 and/or centralized modules 360 may be in communication with one another using various interconnects such as ribbon cables, shield cables, coaxial cables, and so forth. The front-end modules 330 may be coupled to the antenna elements 210 and/or the antenna segments 220 via the transmission lines 230 and/or the electrical signal connectors 240.

The hemispherical geometry of the antenna system 110 may be considered a dome. Such a physical geometry can provide the antenna elements 210 a view of the sky from horizon-to-horizon, 360 degrees around. Multiple antenna taps around the antenna system 110 may be processed such that the antenna elements 210 may be used as an array, or phased array, and not merely one large antenna.

The solar cells 310 may be used to power the various modules. The solar cells 310 may also be used to charge the batteries 340. The batteries may also be used to power the various modules.

Aperture array signal processing algorithms can process data from multiple antenna elements 210 such that the combined antenna may be mathematically focused or steered. The resulting effect may be as though the antennas had been mechanically or physically steered as in a traditional directional antenna. As such, the system can track a moving satellite without employing any moving parts. Increasing the computational resources associated with the antenna system 110 can increase the number of simultaneous satellites that may be tracked.

Signals sampled from the front-end modules 330 may be digitally stored. The signal samples may be analyzed in real-time and/or after collection in order to extract data transmitted from multiple satellite sources. When the location of a satellite is not well known, the location may be refined by combining an aperture array signal algorithm with a compressive sensing algorithm that analyzes the radio data. For example, the data may be pseudo-randomly analyzed using L1 techniques and known physics of satellite orbits. Such techniques may be faster to lock onto a location than traditional Newton-Raphson gradient search algorithms and may support determining a satellite orbit quite quickly. Accordingly, higher quality data may be obtained during a current satellite pass.

It should be appreciated that the various signal processing and computing modules, such as the front-end modules 330 and/or the centralized modules 360 may implement one or more software defined radio (SDR) systems. One or more antenna elements 210 and/or front-end modules 330 may feed input to each SDR among a plurality of SDRs. A separate processing system and/or the centralized modules 360 may receive the outputs from multiple SDRs. The various modules can store data locally, share it among other systems, store it to the cloud, or any combination thereof. It should be appreciated that course processing may occur at a low level (such as at an SDR or within a single dome or antenna system 110) with finer processing taking place at a higher level which may include aggregating output from two or more of the lower-level systems. It should be appreciated that signal processing associated with satellite tracking may comprise adjusting for Doppler shift in the receive frequency due to motion of the satellite relative to the ground station.

Figure 9:
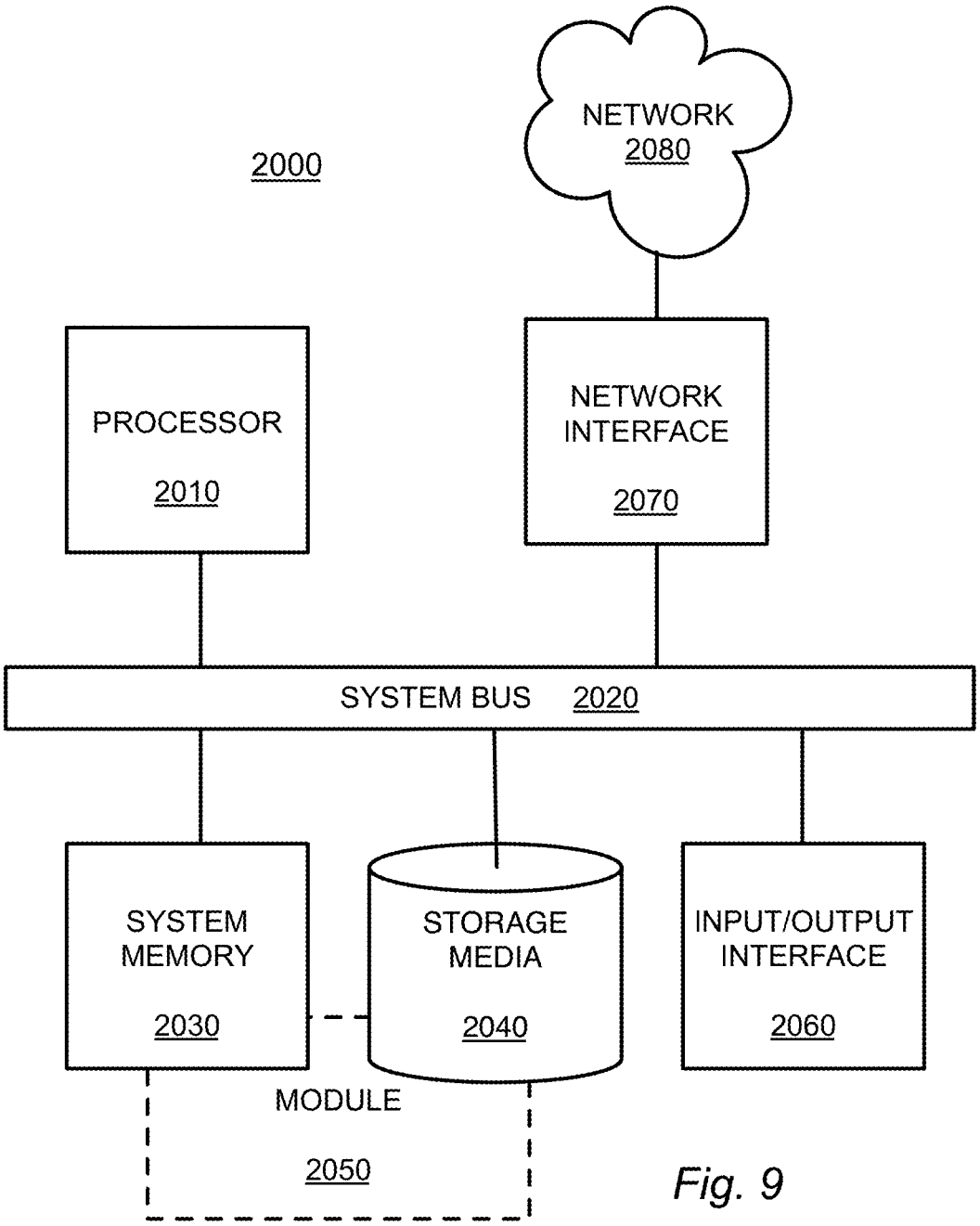
FIG. 9 depicts a computing machine and a module in accordance with one or more embodiments presented herein.

The front-end modules 330, centralized modules 360, SDRs, or any other systems associated with the technology presented herein may be any type of computing machine such as, but not limited to, those discussed in more detail with respect to FIG. 9. Furthermore, any modules associated with any of these computing machines, or any other modules (scripts, web content, software, firmware, or hardware) associated with the technology presented herein may by any of the modules discussed in more detail with respect to FIG. 9. The devices and computing machines discussed herein may communicate with one another as well as other computer machines or communication systems over one or more networks. Such networks may include any type of data or communications links or network technology including any of the network technology discussed with respect to FIG. 9.

FIG. 4 illustrates various fractal-inspired antenna elements 210 within facets 115 of an antenna system 110 in accordance with one or more embodiments presented herein. The antenna elements 210 may be printed, sputtered, evaporated, deposited, or otherwise manufactured onto, or into, the film membrane 320 associated with the outer surface of the antenna system 110. Three or more scaled/repeated/rotated instances of antenna segments 220 may be electrically coupled together at a central point to form each antenna elements 210. The scaled/repeated/rotated antenna element structures may comprise geometries similar to the Sierpinski triangle, the Koch snowflake, or other such fractal-inspired geometries.

Figure 5:
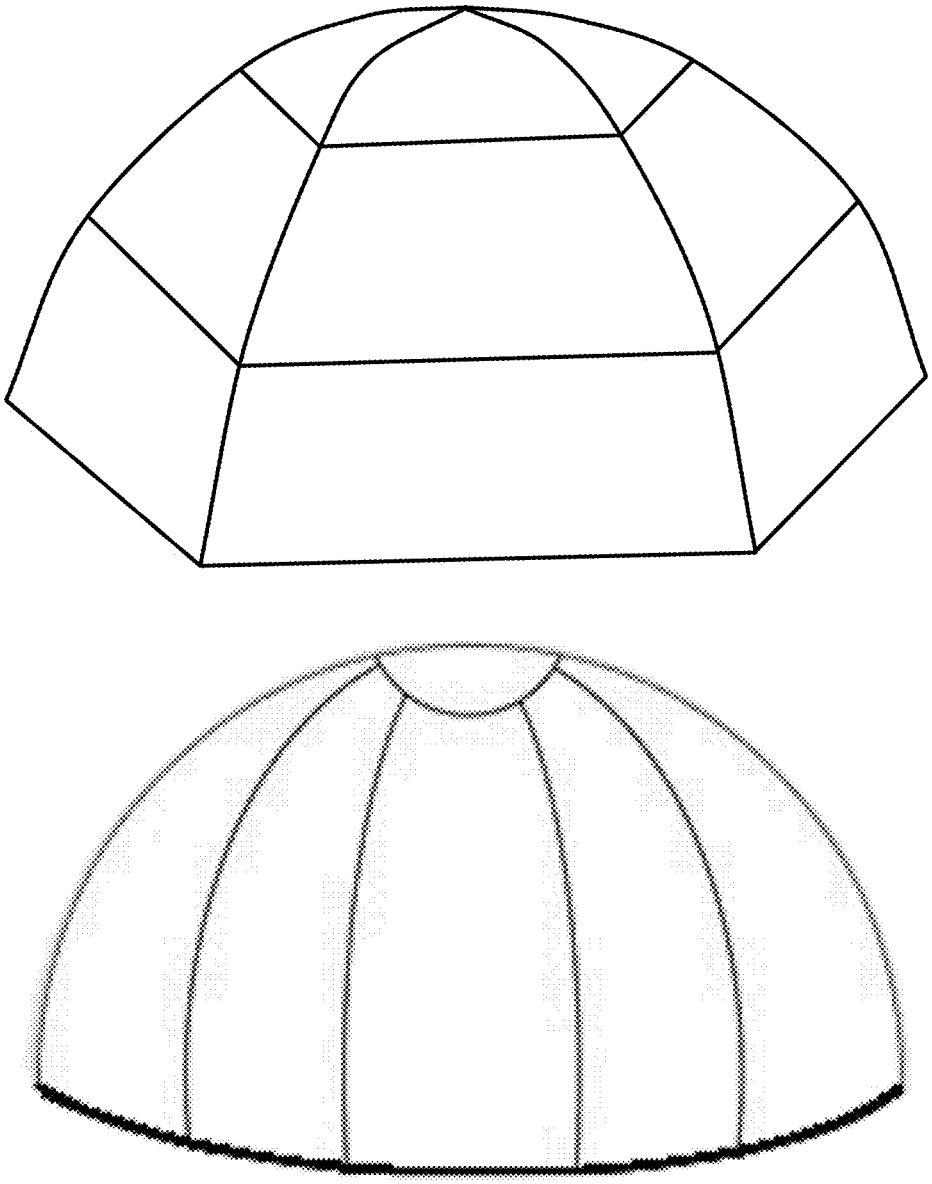
FIG. 5 illustrates a sectored support structure associated with an antenna system in accordance with one or more embodiments presented herein.

FIG. 5 illustrates a sectored support structure associated with an antenna system 110 in accordance with one or more embodiments presented herein. An overall geometry of the sectored support structure may be said to reflect a "beach ball" structure comprising several sector-like facets 115.

Figure 6:
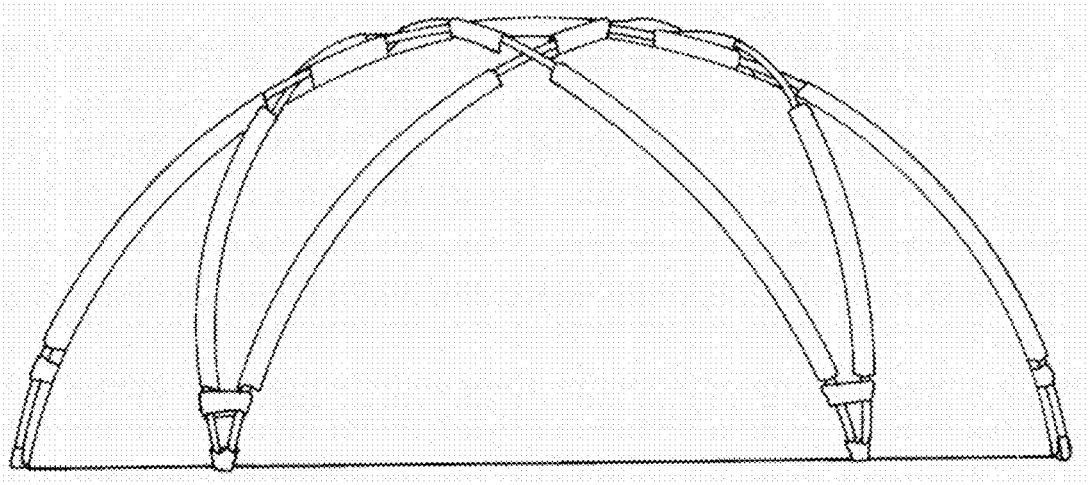
FIG. 6 illustrates a star-like support structure associated with an antenna system in accordance with one or more embodiments presented herein.
Figure 6:
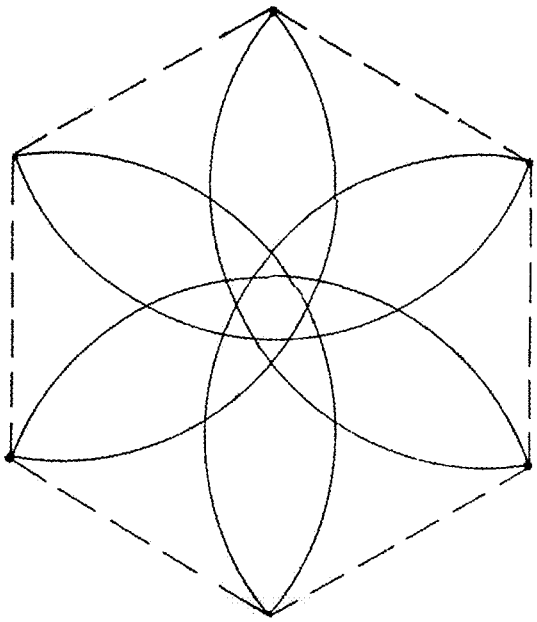

FIG. 6 illustrates a star-like support structure associated with an antenna system 110 in accordance with one or more embodiments presented herein. An overall geometry of the support structure may be said to reflect a star or flow structure comprising several petal-like facets 115.

Figure 7:
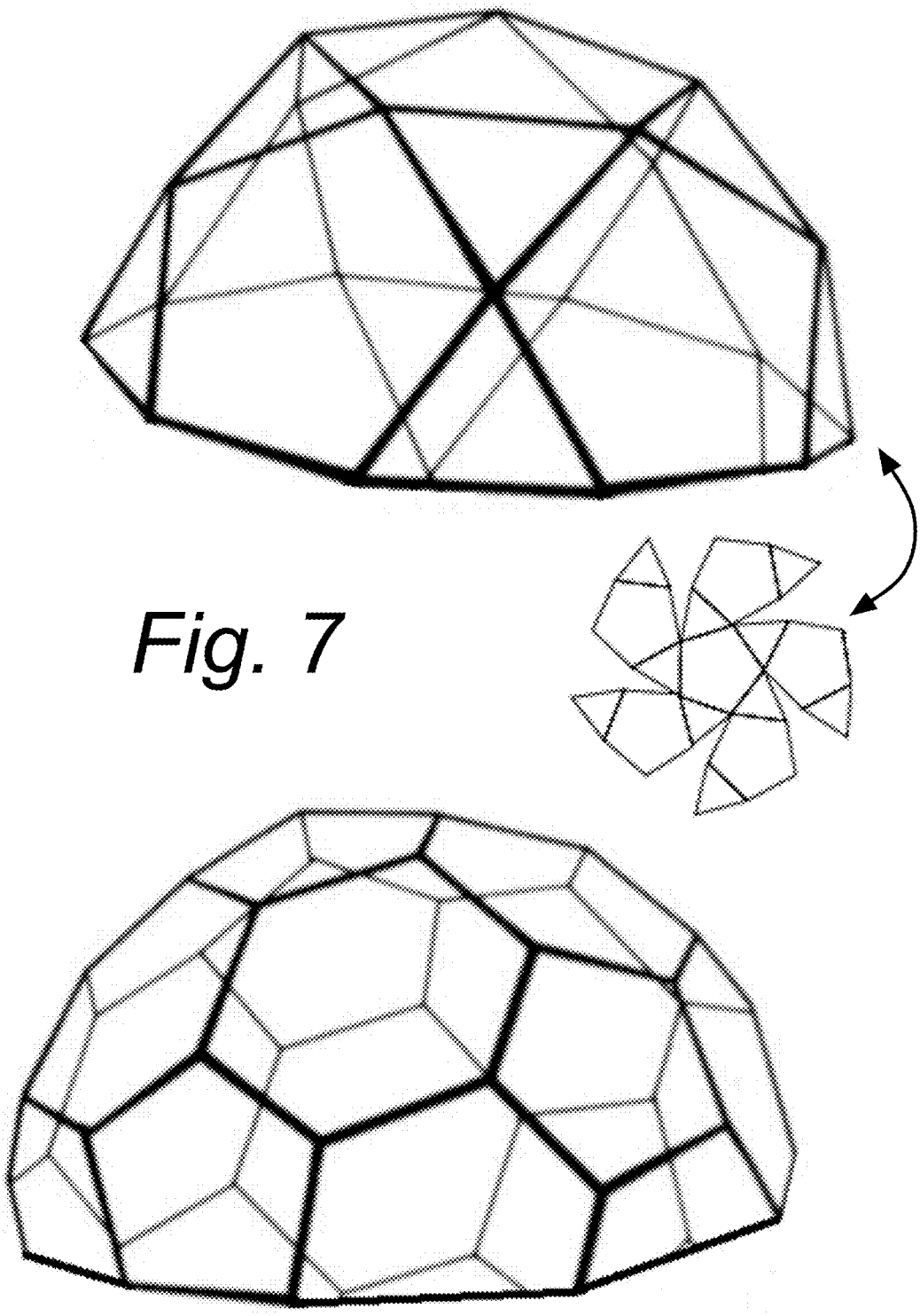
FIG. 7 illustrates two different support structure geometries associated with an antenna system in accordance with one or more embodiments presented herein.

FIG. 7 illustrates two different support structure geometries associated with an antenna system 110 in accordance with one or more embodiments presented herein. An icosidodecahedron support structure may result in facets 115 having geometries substantially associated with pentagons and triangles. A truncated icosahedron support structure may result in facets 115 having geometries substantially associated with pentagons and hexagons.

Example Processes

According to methods and blocks described in the embodiments presented herein, and, in alternative embodiments, certain blocks can be performed in a different order, in parallel with one another, omitted entirely, and/or combined between different example methods, and/or certain additional blocks can be performed, without departing from the scope and spirit of the invention. Accordingly, such alternative embodiments are included in the invention described herein.

Figure 8:
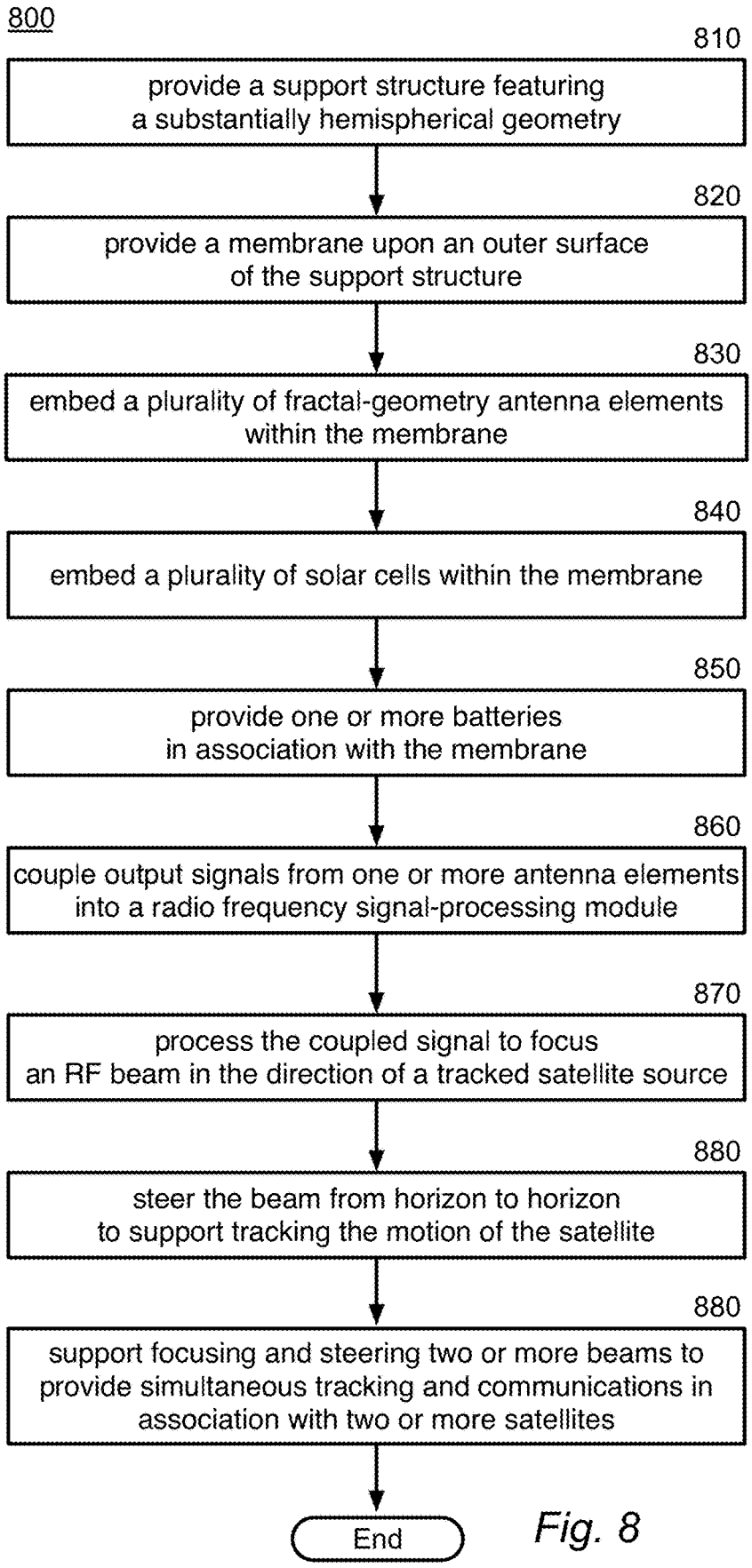
FIG. 8 is a block flow diagram depicting a method for portable aperture array antenna operation supporting communications with multiple simultaneous satellites in accordance with one or more embodiments presented herein.

FIG. 8 is a block flow diagram depicting a method 800 for portable aperture array antenna operation supporting communications with multiple simultaneous satellites in accordance with one or more embodiments presented herein.

In block 810, the antenna system 110 can comprise a support structure featuring a substantially hemispherical geometry.

In block 820, the antenna system 110 can comprise a membrane upon an outer surface of the support structure.

In block 830, the antenna system 110 can comprise a plurality of fractal-geometry antenna elements embedded within the membrane.

In block 840, the antenna system 110 can comprise a plurality of solar cells embedded within the membrane.

In block 850, the antenna system 110 can comprise one or more batteries in association with the membrane.

In block 860, the antenna system 110 can couple output signals from one or more antenna elements into a radio frequency signal-processing module.

In block 870, the antenna system 110 can process the coupled signal to focus a beam in the direction of a tracked satellite source.

In block 880, the antenna system 110 can steer the beam from horizon to horizon in order to track the motion of the satellite across the entire sky without moving parts.

In block 890, the antenna system 110 can support focusing and steering two or more beams to provide simultaneous tracking and communications in association with two or more satellites.

Example Systems

FIG. 9 depicts a computing machine 2000 and a module 2050 in accordance with one or more embodiments presented herein. The computing machine 2000 may correspond to any of the various computers, servers, mobile devices, embedded systems, or computing systems presented herein. The module 2050 may comprise one or more hardware or software elements configured to facilitate the computing machine 2000 in performing the various methods and processing functions presented herein. The computing machine 2000 may include various internal or attached components such as a processor 2010, system bus 2020, system memory 2030, storage media 2040, input/output interface 2060, and a network interface 2070 for communicating with a network 2080.

The computing machine 2000 may be implemented as a conventional computer system, an embedded controller, a laptop, a server, a mobile device, a smartphone, a set-top box, a kiosk, a vehicular information system, one more processors associated with a television, a customized machine, any other hardware platform, or any combination or multiplicity thereof. The computing machine 2000 may be a distributed system configured to function using multiple computing machines interconnected via a data network or bus system.

The processor 2010 may be configured to execute code or instructions to perform the operations and functionality described herein, manage request flow and address mappings, and to perform calculations and generate commands. The processor 2010 may be configured to monitor and control the operation of the components in the computing machine 2000. The processor 2010 may be a general purpose processor, a processor core, a multiprocessor, a reconfigurable processor, a microcontroller, a digital signal processor ("DSP"), an application specific integrated circuit ("ASIC"), a graphics processing unit ("GPU"), a field programmable gate array ("FPGA"), a programmable logic device ("PLD"), a controller, a state machine, gated logic, discrete hardware components, any other processing unit, or any combination or multiplicity thereof. The processor 2010 may be a single processing unit, multiple processing units, a single processing core, multiple processing cores, special purpose processing cores, co-processors, or any combination thereof. According to certain embodiments, the processor 2010 along with other components of the computing machine 2000 may be a virtualized computing machine executing within one or more other computing machines.

The system memory 2030 may include non-volatile memories such as read-only memory ("ROM"), programmable read-only memory ("PROM"), erasable programmable read-only memory ("EPROM"), flash memory, or any other device capable of storing program instructions or data with or without applied power. The system memory 2030 also may include volatile memories, such as random access memory ("RAM"), static random access memory ("SRAM"), dynamic random access memory ("DRAM"), and synchronous dynamic random access memory ("SDRAM"). Other types of RAM also may be used to implement the system memory 2030. The system memory 2030 may be implemented using a single memory module or multiple memory modules. While the system memory 2030 is depicted as being part of the computing machine 2000, one skilled in the art will recognize that the system memory 2030 may be separate from the computing machine 2000 without departing from the scope of the subject technology. It should also be appreciated that the system memory 2030 may include, or operate in conjunction with, a non-volatile storage device such as the storage media 2040.

The storage media 2040 may include a hard disk, a floppy disk, a compact disc read only memory ("CD-ROM"), a digital versatile disc ("DVD"), a Blu-ray disc, a magnetic tape, a flash memory, other non-volatile memory device, a solid state drive ("SSD"), any magnetic storage device, any optical storage device, any electrical storage device, any semiconductor storage device, any physical-based storage device, any other data storage device, or any combination or multiplicity thereof. The storage media 2040 may store one or more operating systems, application programs and program modules such as module 2050, data, or any other information. The storage media 2040 may be part of, or connected to, the computing machine 2000. The storage media 2040 may also be part of one or more other computing machines that are in communication with the computing machine 2000 such as servers, database servers, cloud storage, network attached storage, and so forth.

The module 2050 may comprise one or more hardware or software elements configured to facilitate the computing machine 2000 with performing the various methods and processing functions presented herein. The module 2050 may include one or more sequences of instructions stored as software or firmware in association with the system memory 2030, the storage media 2040, or both. The storage media 2040 may therefore represent examples of machine or computer readable media on which instructions or code may be stored for execution by the processor 2010. Machine or computer readable media may generally refer to any medium or media used to provide instructions to the processor 2010. Such machine or computer readable media associated with the module 2050 may comprise a computer software product. It should be appreciated that a computer software product comprising the module 2050 may also be associated with one or more processes or methods for delivering the module 2050 to the computing machine 2000 via the network 2080, any signal-bearing medium, or any other communication or delivery technology. The module 2050 may also comprise hardware circuits or information for configuring hardware circuits such as microcode or configuration information for an FPGA or other PLD.

The input/output ("I/O") interface 2060 may be configured to couple to one or more external devices, to receive data from the one or more external devices, and to send data to the one or more external devices. Such external devices along with the various internal devices may also be known as peripheral devices. The I/O interface 2060 may include both electrical and physical connections for operably coupling the various peripheral devices to the computing machine 2000 or the processor 2010. The I/O interface 2060 may be configured to communicate data, addresses, and control signals between the peripheral devices, the computing machine 2000, or the processor 2010. The I/O interface 2060 may be configured to implement any standard interface, such as small computer system interface ("SCSI"), serial-attached SCSI ("SAS"), fiber channel, peripheral component interconnect ("PCP"), PCI express (PCIe), serial bus, parallel bus, advanced technology attachment ("ATA"), serial ATA ("SATA"), universal serial bus ("USB"), Thunderbolt, FireWire, various video buses, and the like. The I/O interface 2060 may be configured to implement only one interface or bus technology. Alternatively, the I/O interface 2060 may be configured to implement multiple interfaces or bus technologies. The I/O interface 2060 may be configured as part of, all of, or to operate in conjunction with, the system bus 2020. The I/O interface 2060 may include one or more buffers for buffering transmissions between one or more external devices, internal devices, the computing machine 2000, or the processor 2010.

The I/O interface 2060 may couple the computing machine 2000 to various input devices including mice, touch-screens, scanners, biometric readers, electronic digitizers, sensors, receivers, touchpads, trackballs, cameras, microphones, keyboards, any other pointing devices, or any combinations thereof. The I/O interface 2060 may couple the computing machine 2000 to various output devices including video displays, speakers, printers, projectors, tactile feedback devices, automation control, robotic components, actuators, motors, fans, solenoids, valves, pumps, transmitters, signal emitters, lights, and so forth.

The computing machine 2000 may operate in a networked environment using logical connections through the network interface 2070 to one or more other systems or computing machines across the network 2080. The network 2080 may include wide area networks ("WAN"), local area networks ("LAN"), intranets, the Internet, wireless access networks, wired networks, mobile networks, telephone networks, optical networks, or combinations thereof. The network 2080 may be packet switched, circuit switched, of any topology, and may use any communication protocol. Communication links within the network 2080 may involve various digital or an analog communication media such as fiber optic cables, free-space optics, waveguides, electrical conductors, wireless links, antennas, radio-frequency communications, and so forth.

The processor 2010 may be connected to the other elements of the computing machine 2000 or the various peripherals discussed herein through the system bus 2020. It should be appreciated that the system bus 2020 may be within the processor 2010, outside the processor 2010, or both. According to some embodiments, any of the processor 2010, the other elements of the computing machine 2000, or the various peripherals discussed herein may be integrated into a single device such as a system on chip ("SOC"), system on package ("SOP"), or ASIC device.

In situations in which the systems discussed here collect personal information about users, or may make use of personal information, the users may be provided with a opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, a user's identity may be treated so that no personally identifiable information can be determined for the user, or a user's geographic location may be generalized where location information is obtained (such as to a city, ZIP code, or state level), so that a particular location of a user cannot be determined. Thus, the user may have control over how information is collected about the user and used by a content server.

One or more aspects of embodiments may comprise a computer program that embodies the functions described and illustrated herein, wherein the computer program is implemented in a computer system that comprises instructions stored in a machine-readable medium and a processor that executes the instructions. However, it should be apparent that there could be many different ways of implementing embodiments in computer programming, and the invention should not be construed as limited to any one set of computer program instructions. Further, a skilled programmer would be able to write such a computer program to implement an embodiment of the disclosed invention based on the appended flow charts and associated description in the application text. Therefore, disclosure of a particular set of program code instructions is not considered necessary for an adequate understanding of how to make and use the invention. Further, those skilled in the art will appreciate that one or more aspects of the invention described herein may be performed by hardware, software, or a combination thereof, as may be embodied in one or more computing systems. Moreover, any reference to an act being performed by a computer should not be construed as being performed by a single computer as more than one computer may perform the act.

The example embodiments described herein can be used with computer hardware and software that perform the methods and processing functions described previously. The systems, methods, and procedures described herein can be embodied in a programmable computer, computer-executable software, or digital circuitry. The software can be stored on computer-readable media. For example, computer-readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays ("FPGA"), etc.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of embodiments of the invention. Accordingly, such alternative embodiments are included in the inventions described herein.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

What is claimed is:

1. A portable aperture array antenna system, comprising:

a support structure comprising a substantially hemispherical geometry formed of a plurality of rigid linear elements;

a membrane positionable upon an outer surface of the support structure, the membrane comprising a thin film;

a plurality of antenna elements disposed on the membrane, the antenna elements configured as an aperture array antenna;

one or more signal-processing modules; and a radio frequency transmission assembly operable to couple output signals from one or more of the antenna elements into the one or more signal-processing modules, wherein the one or more signal-processing modules comprise a computer processor and digital data storage media capable of storing digital data associated with the output signals from one or more of the antenna elements, the digital data storage media storing instructions that when executed by the computer processor:

apply an aperture array signal processing algorithm to the digital data from a plurality of antenna elements of the plurality of antenna elements, model the motion of a first tracked satellite based on the aperture array signal processing algorithm, focus a first electromagnetic beam in a direction of the first tracked satellite based on the modeled motion, steer the first electromagnetic beam from horizon to horizon to follow the modeled motion of the first tracked satellite without motion of physical components, and focus and steer a second electromagnetic beam in a direction of a second tracked satellite.

2. The portable aperture array antenna system of claim 1, wherein the antenna elements are embedded with the membrane.

3. The portable aperture array antenna system of claim 1, further comprising one or more batteries embedded within the membrane.

4. The portable aperture array antenna system of claim 1, further comprising one or more solar cells embedded within the membrane.

5. The portable aperture array antenna system of claim 1, wherein focusing and steering a second electromagnetic beam comprises adjusting respective magnitudes and phases of radio frequency signals associated with two or more of the plurality of antenna elements.

6. The portable aperture array antenna system of claim 1, wherein the one or more signal-processing modules are positioned within the shape formed by the support structure and between the membrane and the ground on which the support structure sits.

7. The portable aperture array antenna system of claim 1, wherein the digital data storage media stores instructions that when executed by the computer processor, combine a compressive sensing algorithm that analyzes the digital data with the aperture array signal algorithm, when the location of a satellite is not well known.

8. The portable aperture array antenna system of claim 1, wherein the thin film comprises a plastic film material or woven material.

9. The portable aperture array antenna system of claim 1, further comprising one or more solar cells embedded within the membrane, one or more batteries embedded within the membrane, and wherein the antenna elements are embedded within the membrane.

10. The portable aperture array antenna system of claim 9, wherein:

the thin-film comprises a plastic film; and the one or more signal-processing modules are positioned within the shape formed by the support structure and between the membrane and the ground on which the support structure sits.

11. A method for operating a portable aperture array antenna, comprising:

providing a support structure comprising a substantially hemispherical geometry formed of a plurality of rigid linear elements;

positioning a membrane upon an outer surface of the support structure, wherein the membrane comprises a thin-film and comprises a plurality of antenna elements configured thereon as an aperture array antenna;

coupling output signals from one or more of the antenna elements into one or more processing modules;

storing digital data associated with the output signals from one or more of the antenna elements;

applying an aperture array signal processing algorithm to the digital data from a plurality of antenna elements of the plurality of antenna elements, modeling, with one or more of the processing modules, the motion of two or more tracked satellites, based on the aperture array signal processing algorithm;

focusing, with one or more of the processing modules, two or more electromagnetic beams in the respective directions of the two or more tracked satellites, based on the modeling; and steering, with one or more of the processing modules, the two or more electromagnetic beams from horizon to horizon to follow the respective modeled motions of the two or more tracked satellites without motion of physical components.

12. The method of claim 11, wherein the antenna elements are embedded within the membrane.

13. The method of claim 11, wherein focusing and steering electromagnetic beams comprises adjusting respective magnitudes and phases of radio frequency signals associated with two or more of the plurality of antenna elements.

14. The method of claim 11, wherein the membrane comprises one or more solar cells embedded within the membrane.

15. The method of claim 11, wherein the one or more processing modules are positioned within the shape formed by the support structure and between the membrane and the ground on which the support structure sits.

16. The method of claim 11, wherein the membrane comprises a layered structure.

17. The method of claim 11, further comprising combining a compressive sensing algorithm that analyzes the digital data with the aperture array signal algorithm, when the location of a satellite is not well known.

18. The method of claim 11, wherein the thin film comprises a plastic film material or woven material.

19. The method of claim 11, wherein one or more solar cells are embedded within the membrane, one or more batteries are embedded within the membrane, and the antenna elements are embedded within the membrane.

20. The method of claim 19, wherein:

the thin-film comprises a plastic film; and the one or more signal-processing modules are positioned within the shape formed by the support structure and between the membrane and the ground on which the support structure sits.

* * * * *